US008082600B2

(12) United States Patent
Morin

(10) Patent No.: US 8,082,600 B2
(45) Date of Patent: Dec. 27, 2011

(54) PROTECTIVE HELMET WITH MOBILE VISOR

(75) Inventor: Claude Morin, Nice (FR)

(73) Assignee: Roof International, Pegomas (FR)

( * ) Notice: Subject to any disclaimer, the term of this patent is extended or adjusted under 35 U.S.C. 154(b) by 1053 days.

(21) Appl. No.: 11/916,303

(22) PCT Filed: May 26, 2006

(86) PCT No.: PCT/EP2006/062641

§ 371 (c)(1),
(2), (4) Date: Dec. 7, 2007

(87) PCT Pub. No.: WO2006/128833

PCT Pub. Date: Dec. 7, 2006

(65) Prior Publication Data

US 2008/0196148 A1 Aug. 21, 2008

(30) Foreign Application Priority Data

Jun. 3, 2005 (FR) ..... 05 51488

(51) Int. Cl.
*A42B 3/18* (2006.01)

(52) U.S. Cl. ..... 2/424; 2/410; 2/15; 2/6.5

(58) Field of Classification Search ..... 2/455, 410, 2/6.1, 6.5, 6.7, 424, 15, 453, 9
See application file for complete search history.

(56) References Cited

U.S. PATENT DOCUMENTS

| | | | | |
|---|---|---|---|---|
| 3,833,935 | A * | 9/1974 | Ansite et al. | 2/6.2 |
| 4,769,857 | A * | 9/1988 | Cianfanelli et al. | 2/424 |
| 4,794,652 | A * | 1/1989 | Piech von Planta et al. | 2/414 |
| 6,226,803 | B1 * | 5/2001 | Tanaka | 2/424 |
| 6,237,161 | B1 * | 5/2001 | Lee | 2/414 |
| 6,253,386 | B1 * | 7/2001 | Gafforio | 2/424 |
| 6,598,238 | B2 * | 7/2003 | Hong et al. | 2/424 |
| 7,024,704 | B2 * | 4/2006 | Gafforio et al. | 2/424 |
| 7,398,561 | B2 * | 7/2008 | Kim et al. | 2/424 |
| 7,814,579 | B2 * | 10/2010 | Dion | 2/425 |

FOREIGN PATENT DOCUMENTS

| | | | |
|---|---|---|---|
| EP | 0 993 784 | A1 | 4/2000 |
| EP | 1 101 419 | A1 | 5/2001 |
| FR | 2 876 882 | A | 4/2006 |

* cited by examiner

*Primary Examiner* — Christopher Harmon
(74) *Attorney, Agent, or Firm* — Young & Thompson

(57) ABSTRACT

The invention concerns a protective helmet comprising a shell (1) whereon are rotatably mounted a visor (2) and a chin strap (3), the lower portion of the visor (2) being urged to rest on a zone (4) of the chin strap (3) when they are lowered and the chin strap (3) capable of being raised about the visor (2). The invention is characterized in that the helmet is such that it comprises additional means for moving the visor (2) configured to bring its lower edge closer to or move it away from the raising trajectory of the support zone (4) on the chin strap (3).

20 Claims, 8 Drawing Sheets

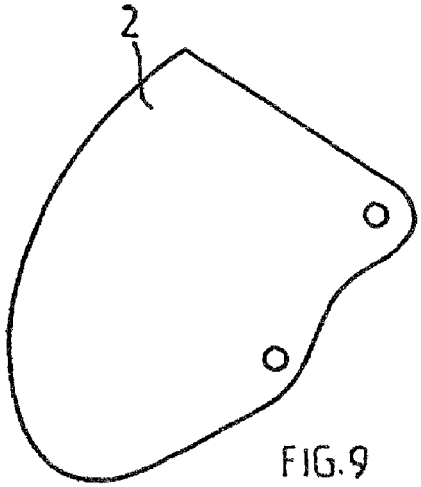
FIG.9
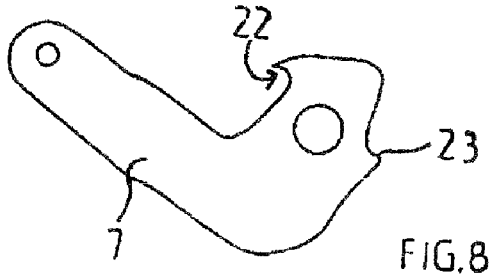
FIG.8
FIG.10
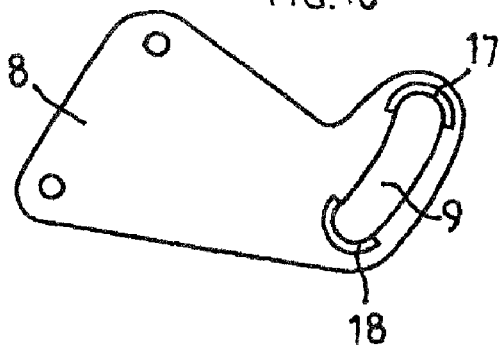
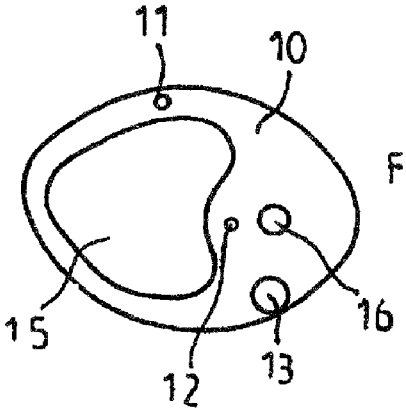
FIG.11
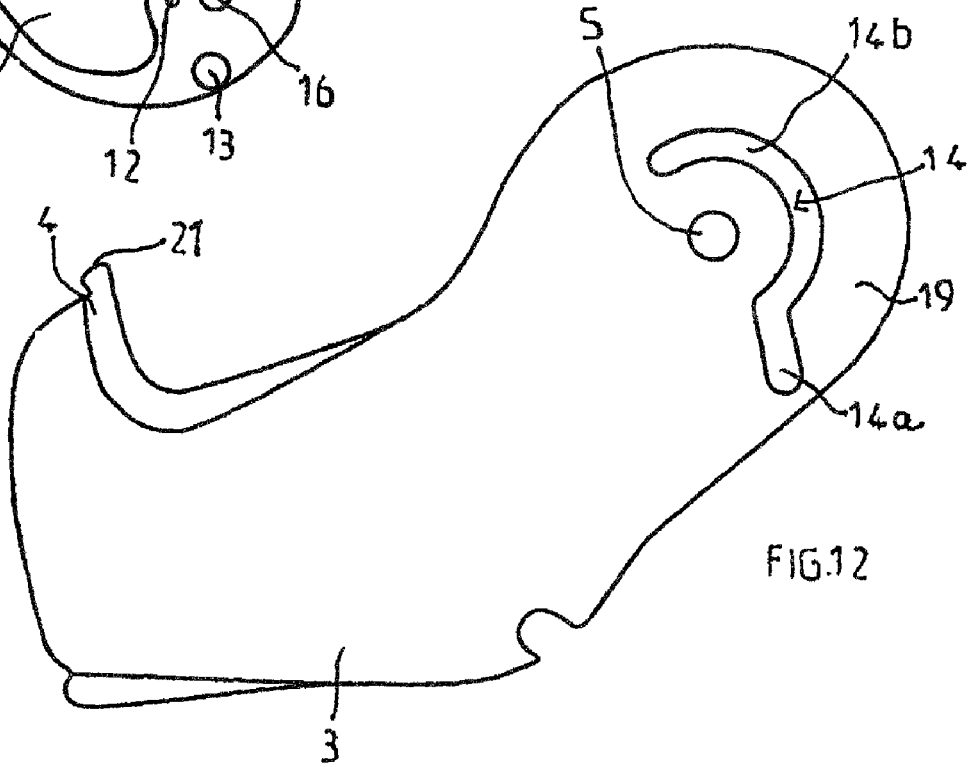
FIG.12

PROTECTIVE HELMET WITH MOBILE VISOR

FIELD OF THE INVENTION

The present invention concerns a protective helmet comprising, in a general manner, a shell on which is mounted a visor and a chin strap.

BACKGROUND OF THE INVENTION

The helmet according to the invention is intended for use by motorcyclists wanting an integral helmet, that is to say which provides complete protection of the motorcyclist's head, by the presence of a part that protects the chin, hereafter called the chin strap, while the mobility of the chin strap and the visor ensure that the helmet configuration can be changed.

A protective helmet, in particular for use by racing motorcyclists consisting of a visor mounted on the shell of a helmet, a chin strap attached to the shell and able to be raised over the visor towards the rear of the shell by a rotatable movement is described in patent EP-A-993 784. According to this prior art, the chin strap has a rotational axis that is offset upwards relative to the axis of the visor so that the chin strap can be raised without rubbing on the visor. According to this arrangement, the visor should rest on inner zone of the chin strap by its lower edge.

There is a need for a helmet with a chin strap and visor which are mobile in an upward direction so as to ensure that the visor effectively bears on the chin strap, in particular to form a seal when in the lowered position, while allowing the chin strap to be easily raised above the visor.

One aim of the invention is to propose a solution to this problem.

SUMMARY OF THE INVENTION

The invention then allows the chinstrap and the visor to coact in the lowered position to form a perfect seal. In particular, according to a preferred embodiment, the visor is able to coact with an outer part of the chinstrap which has an edge behind the visor so that it can be blocked perfectly and the seal maximized.

According to a preferred embodiment, the visor is not only rotatably mounted relative to the shell but also has additional mobility in inclination along an axis of rotation that is different from that of its rotation relative to the shell so that its inclination can be changed and the visor moved out of the path of the upward trajectory of the chinstrap.

According to another advantage of the invention, the mobility of the visor is interlocked to that of the chinstrap so that raising the chinstrap simultaneously raises the visor. Moreover, the interlocking means can be configured so that the visor can be raised faster than the chinstrap, which releases the visor from its trajectory on the first phase of chinstrap raising.

It will be noted that there are many possible configurations of the helmet according to the invention, in particular for coacting of the chinstrap and the visor.

Other aims and advantages will become apparent in the description of a preferred embodiment which follows, which however is not restrictive.

The present invention concerns a protective helmet with a shell on which are rotatably mounted a visor and chinstrap, the lower part of the visor resting against a zone of the chinstrap when they are lowered, the chinstrap being upwardly movable around the visor. According to the invention, the helmet has additional means for moving the visor which are configured to bring its lower edge closer or move it away from the upward trajectory of the support zone on the chinstrap.

According to the invention, this helmet may take the form of the preferred embodiment described below:

- the additional mobility means are means for inclining the visor,
- the inclination means include, on each side of the shell, a rod mounted to swivel at one of its ends on the visor, and the other end on the rotational axis of the visor on the shell,
- it includes a lateral support on each side joined to the visor in the form of an oblong guide hole for the rotational axis,
- it includes means for interlocking the additional mobility of the visor with raising of the chinstrap,
- it includes means for interlocking the rotation of the visor relative to the shell with raising of the chinstrap,
- it includes means for interlocking the rotation and inclination of the visor with raising of the chinstrap, the aforementioned means comprising:

a rotatably mounted cam on the shell and the means for driving the cam rotatably by rotation of the chinstrap during its first raising phase, at least one finger joined to the cam which presses on a bearing surface of the rod so as to drive the rod and the visor rotatably, a cavity formed in the cam and able to bear on an upper stop and a lower stop forming the limits of the oblong hole so as to drive the lateral support around the rotational axis,

- the drive means comprise a drive device joined to the cam and guided in a track formed in a drive part joined to the chin strap, the said track comprising a roughly radial part within which the drive device is driven rotatably and a roughly tangential part within which the drive device is not driven rotatably,
- the cam has a finger which exerts a pressure on a bearing surface of the rod so as to drive the rod and the visor rotatably in an upward movement when the chinstrap is slack in the lowered position and the visor is lowered,
- the means for interlocking the visor in rotation relative to the shell with raising of the chinstrap are configured in order to generate higher angular velocity for the visor than for the chinstrap.

BRIEF DESCRIPTION OF THE DRAWINGS

The drawings attached are given as examples and are not restrictive. They represent only one embodiment of the invention to allow it to be easily understood.

FIGS. 8 to 12 show successively a view of the rod, the visor, the side support, the cam, and the chinstrap coacting in the invention.

DETAILED DESCRIPTION

Figure 1:
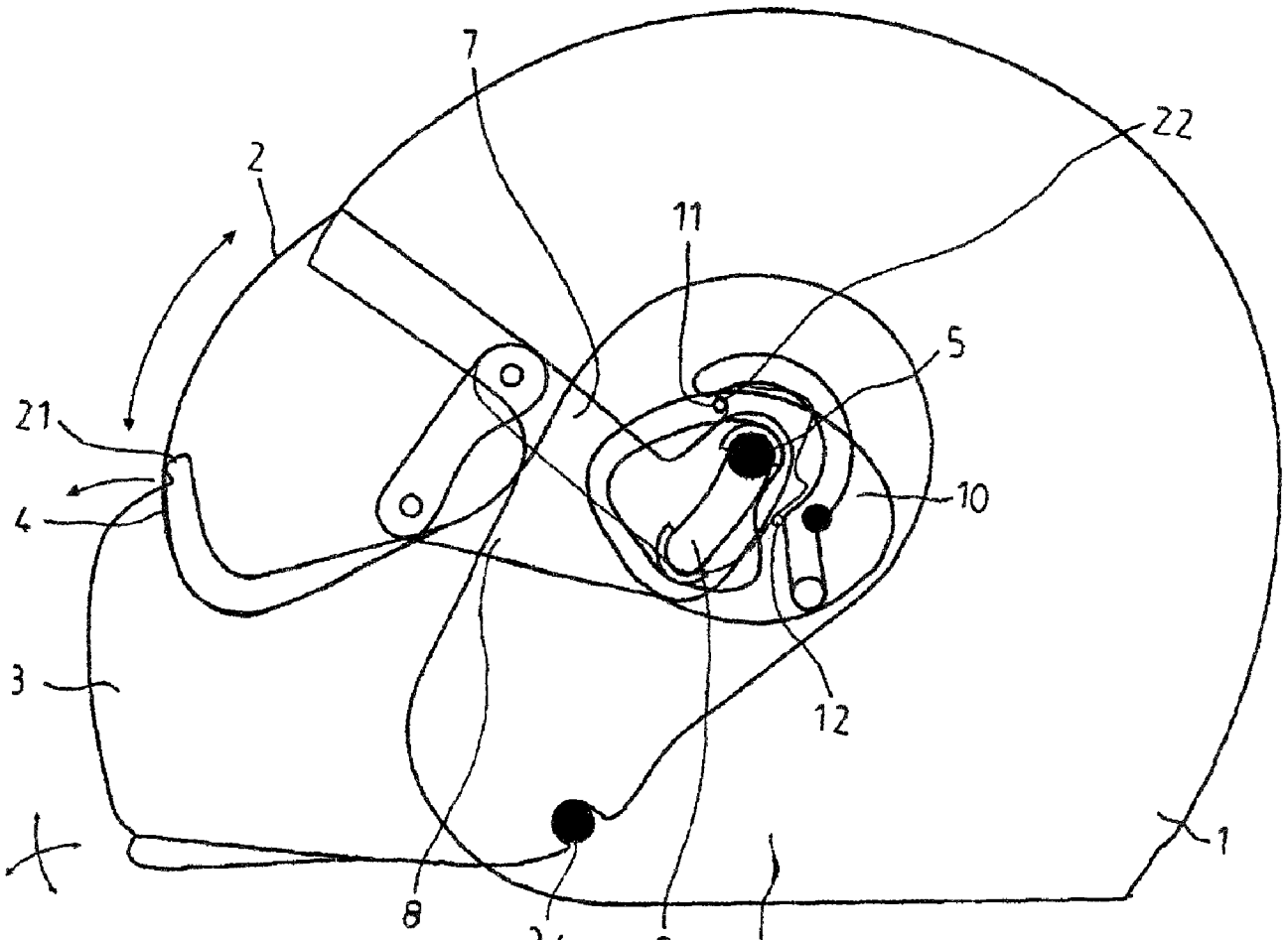
FIG. 1 is a side view of a helmet according to the invention with the chinstrap and visor lowered in the active position.

By reference to FIG. 1 and in a known manner in its own right, the invention has the form of a helmet with a shell 1 protecting the rear of the motorcyclist's head. On each side 6 of shell 1 are means for mounting a chinstrap 3 and visor 2. More precisely, chin strap 3 and visor 2 are articulated relative to shell 1 through rotational axis 5. In the example shown, it consists of a single axis of rotation for the chinstrap and the visor.

In the lowered position, the lower portion of visor 2 bears on zone 4 formed appreciably in the upper part of chinstrap 3. More precisely, in the example illustrated and as shown on FIG. 2 in particular, bearing zone 4 consists of an edge 21 in front of which is positioned the lower portion of visor 2. In this configuration, the unit is very tight and has high mechanical strength. Indeed, in its lower portion, visor 2 is maintained perfectly by the chinstrap at the level of bearing zone 4 with edge 21.

To allow chin strap 3 to be raised without rubbing against the outer surface of visor 2, visor 2 is provided with additional mobility so that its lower edge can move closer or away from the upward trajectory of support zone 4 of chin strap 3.

In the example shown, the additional mobility consists of an inclination of visor 2 along an axis of rotation different from axis 5.

Figure 3:
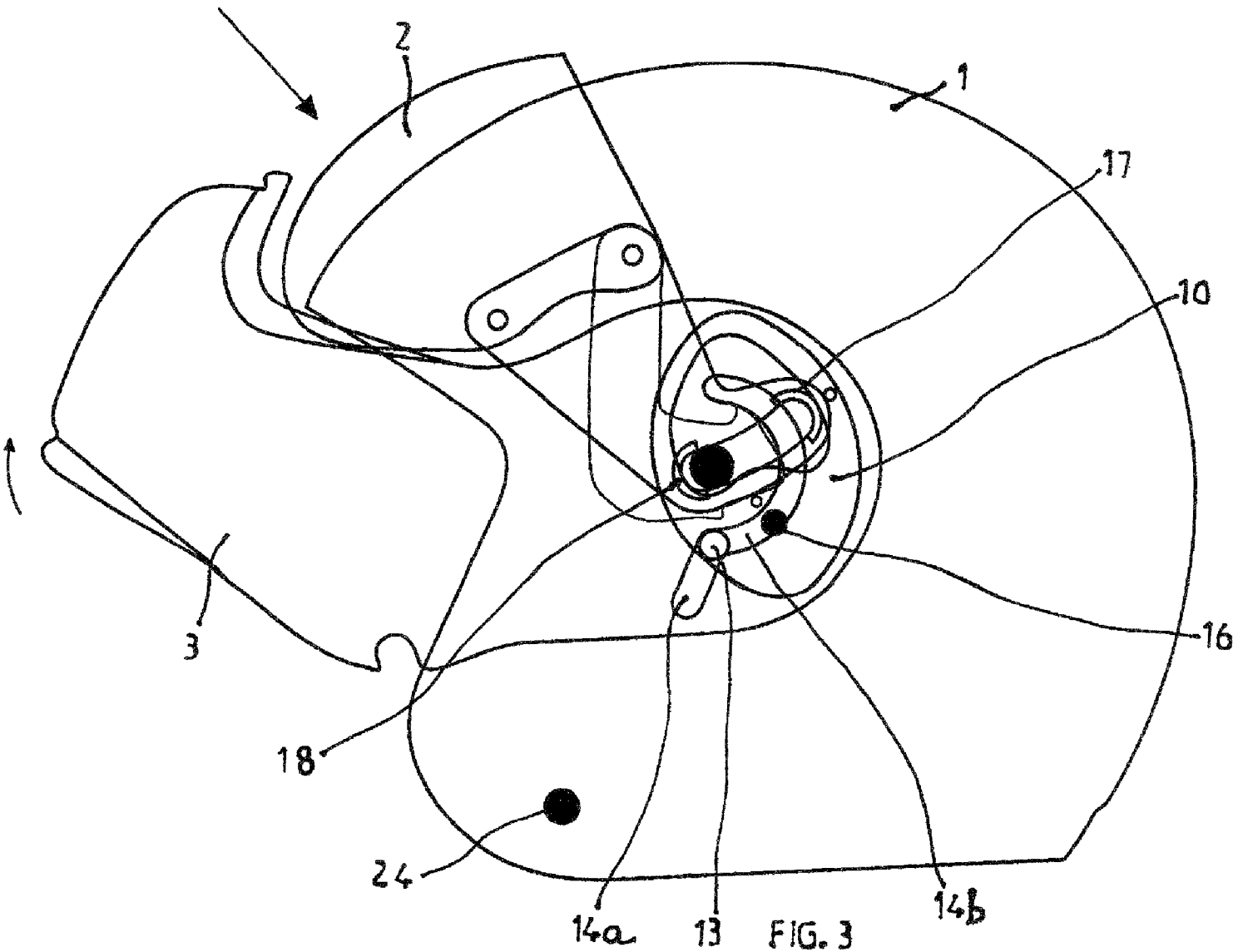
FIG. 3 shows a later phase with additional mobility of the visor.

Thus, as shown on FIG. 3, the means of inclination allow the lower edge of the visor to be inserted before chin strap 3 passes over visor 2.

The various figures show an embodiment of the means of inclination. In this context, at the level of each side 6 of shell 1 is mounted a rod 7 swiveling at one of its ends on visor 2 and assembled rotatably at its other end on axis of rotation 5. It will be easily understood that additional rotatable mobility is generated for the visor by means of rod 7.

Figure 2:
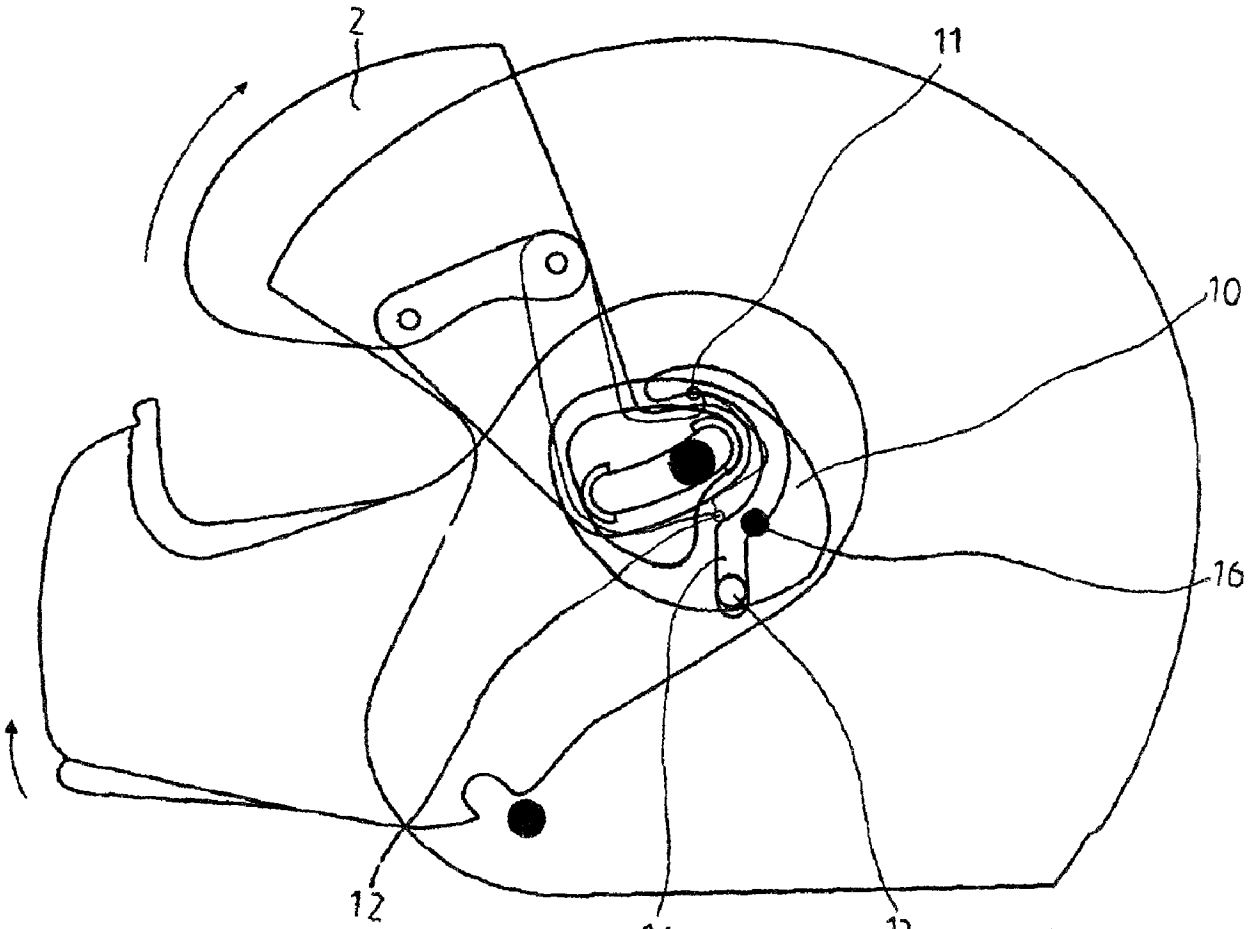
FIG. 2 shows a first phase of visor and chinstrap movement.

Thus, rotation around axis 5 is created when visor 2 is raised, as shown on FIG. 2, followed by or simultaneously with an inclination as shown on FIG. 3.

There is an advantage in limiting the possibilities of angular displacement between rod 7 and visor 2 so as to limit the movement.

Still referring to the figures, a side support 8 is present at each side 6 and is formed joined to visor 2, of which it may constitute the simple extension. The side support has an oblong hole 9 in it to guide the axis of rotation 5.

Visor 2 may be moved manually by the user both rotatably around axis 5 and in inclination through rod 7. However, there is an advantage in visor displacement being generated automatically on raising chin strap 3.

The means for controlling the displacement of visor 2 are described for this purpose, both in its rotation relative to shell 1 and in its additional mobility in inclination. The example shown is not restrictive and interlocking could for instance only relate to the additional mobility or the rotation of the visor. In addition, the control means proposed here may be appropriate to drive a visor 2 without additional mobility.

The interlocking means illustrated here show means joined to chin strap 3 capable of generating a drive force on visor 2 through cam 10.

Cam 10 is positioned between visor 2 and chin strap 3 and is hidden by the side of chin strap 3. Cam 10 is rotatably mounted on shell 1 by axis 16.

Drive part 19 is formed joined to the side of chin strap 3, which in this case is roughly circular even though this shape is not restrictive, and shows a displacement track 14 for a drive body 13 joined to cam 10.

This part 19 can be added to chin strap 3 or form a single part with the latter which it then forms part of.

Track 14 has a radial part 14*a* which, when the drive device 13 is positioned in this part, allows part 19 to apply a drive force on cam 10. Track 14 also has a tangential part 14*b* in which, by tangential orientation of the track relative to the direction of rotational movement of part 19, no effort is transmitted to drive device 13.

Thus, cam 10 is driven on a first phase of raising chin strap 3 when drive body 13 is present in radial part 14*a* of displacement track 14 of part 19. During a subsequent raising phase, after the continued rotation of part 19 body 13 reaches tangential part 14*b* of displacement track 14 of part 19, which causes no further rotation of cam 10.

Cavity 15 is arranged in cam 10 so as to form a wall for the application and guidance of upper stop 17 and lower stop 18 executed in relief at the two ends of oblong hole 9 of lateral support 8.

The coacting of stops 17, 18 and cavity 15 ensures the position of the side support 8 changes relative to rotational axis 5. In FIG. 1, rotational axis 5 is at the level of the upper stop 17, which generates an active position in which rod 7 and side support 8 are not inclined relative to one another. In FIG. 2, axis 5 has evolved in oblong hole 9 and reaches, in FIG. 3, lower stop 18. In this latter position, the inclination of the visor is maximum, showing the angular offset of rod 7 compared to side support 8.

In addition to the inclination produced for visor 2, cam 10 allows visor 2 to be raised around shell 1.

To this end, cam 10 has a finger 11 positioned towards its upper edge and capable of exercising a force on bearing surface 22 in the form of a hook formed on link rod 7 so that finger 11 pushes on surface 22 when cam 10 is activated rotatably by raising chin strap 3. FIG. 2 shows this pushing phase.

After completely raising visor 2, a stop not shown is advantageously created to limit raising.

The various kinematic elements of the system described here can be advantageously configured to cause faster angular displacement of visor 2 relative to chin strap 3. This occurs, in particular, by positioning the point of contact of finger 11/surface 22 close to the axis of rotation 5 so as to generate considerable angular displacement from a low tangential displacement of the drive elements.

The case shown corresponds to this embodiment.

FIGS. 1 to 7 show successive phases for use of the protective helmet described here.

Thus, in FIG. 1, chin strap 3 and visor 2 are in the lowered active protection position.

In FIG. 2, the user has begun raising the chin strap, which causes quicker raising of visor 2.

At the stage of FIG. 3, after raising visor 2 along axis 5, the latter creates additional mobility so as to insert its lower edge relative to the raising trajectory of support zone 4 of chin strap 3.

Chin strap 3 can then be raised freely without rubbing on visor 2.

Figure 4:
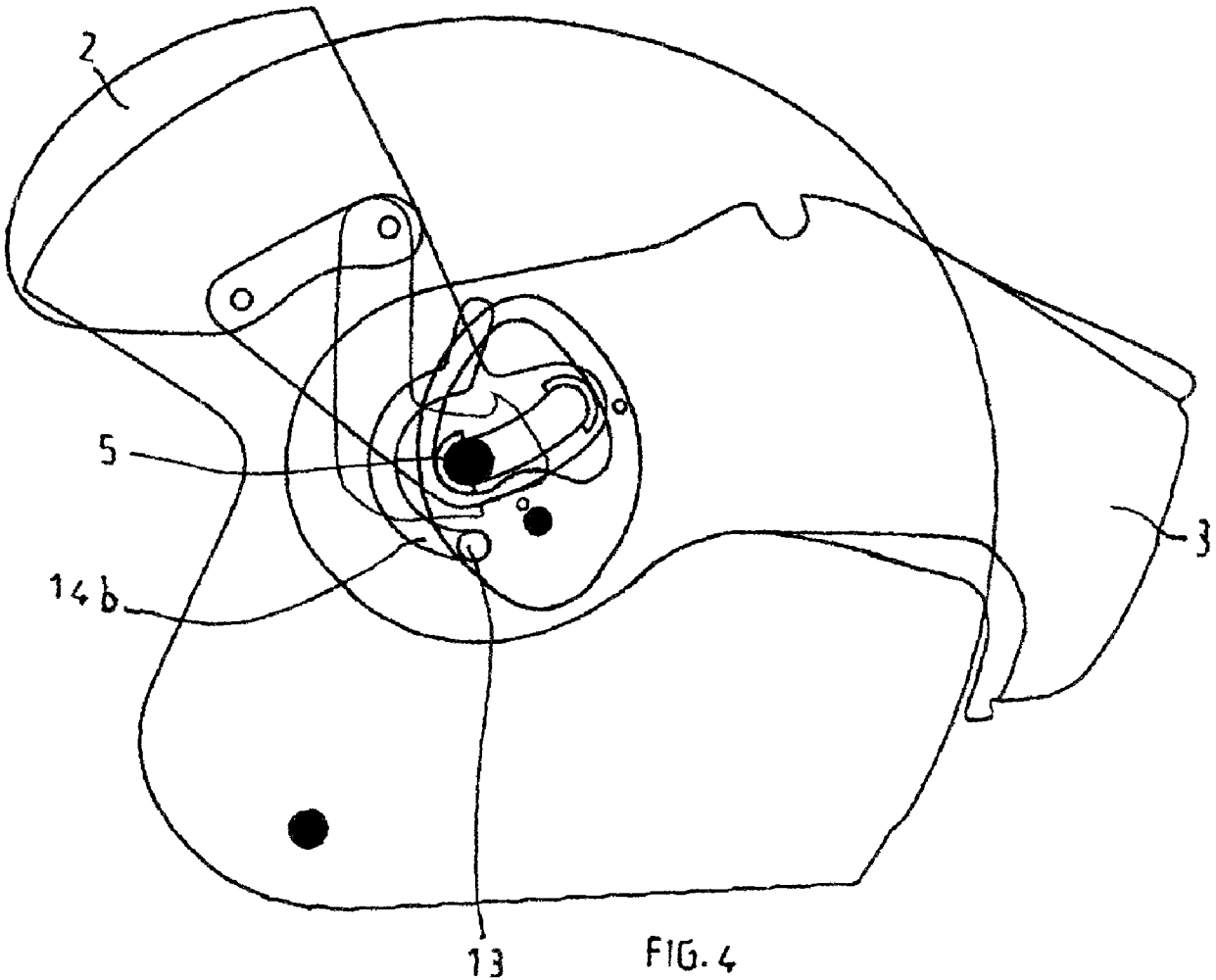
FIG. 4 shows a more raised position of the chinstrap relative to the shell.

For instance, the position illustrated in FIG. 4 may be reached.

Figure 5:
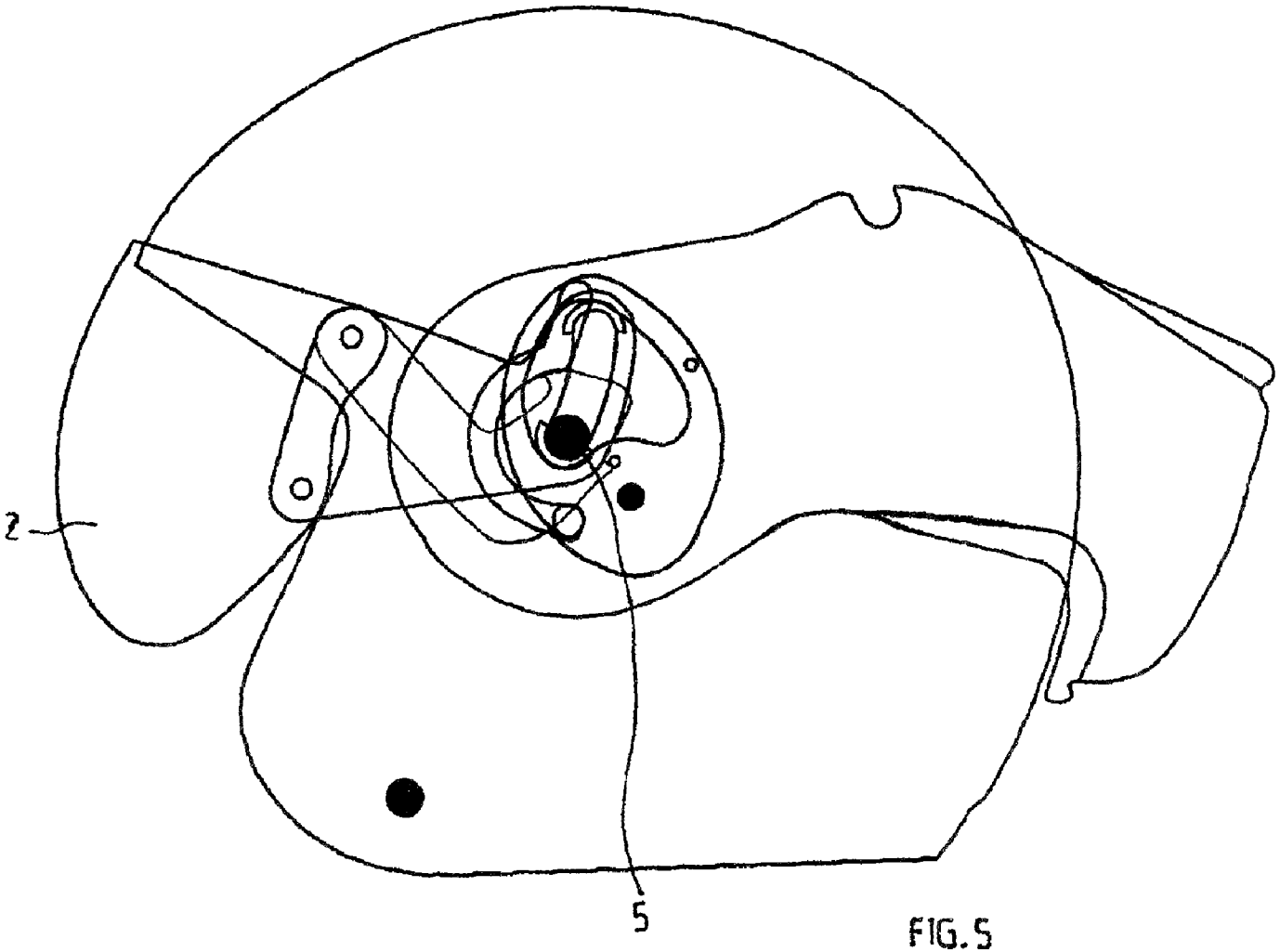
FIG. 5 shows lowering of the visor when the chinstrap is retracted.

FIG. 5 shows a possibility according to which the user uses the helmet in the "jet" position in which visor 2 is folded back but chin strap 3 remains inactive.

Figure 6:
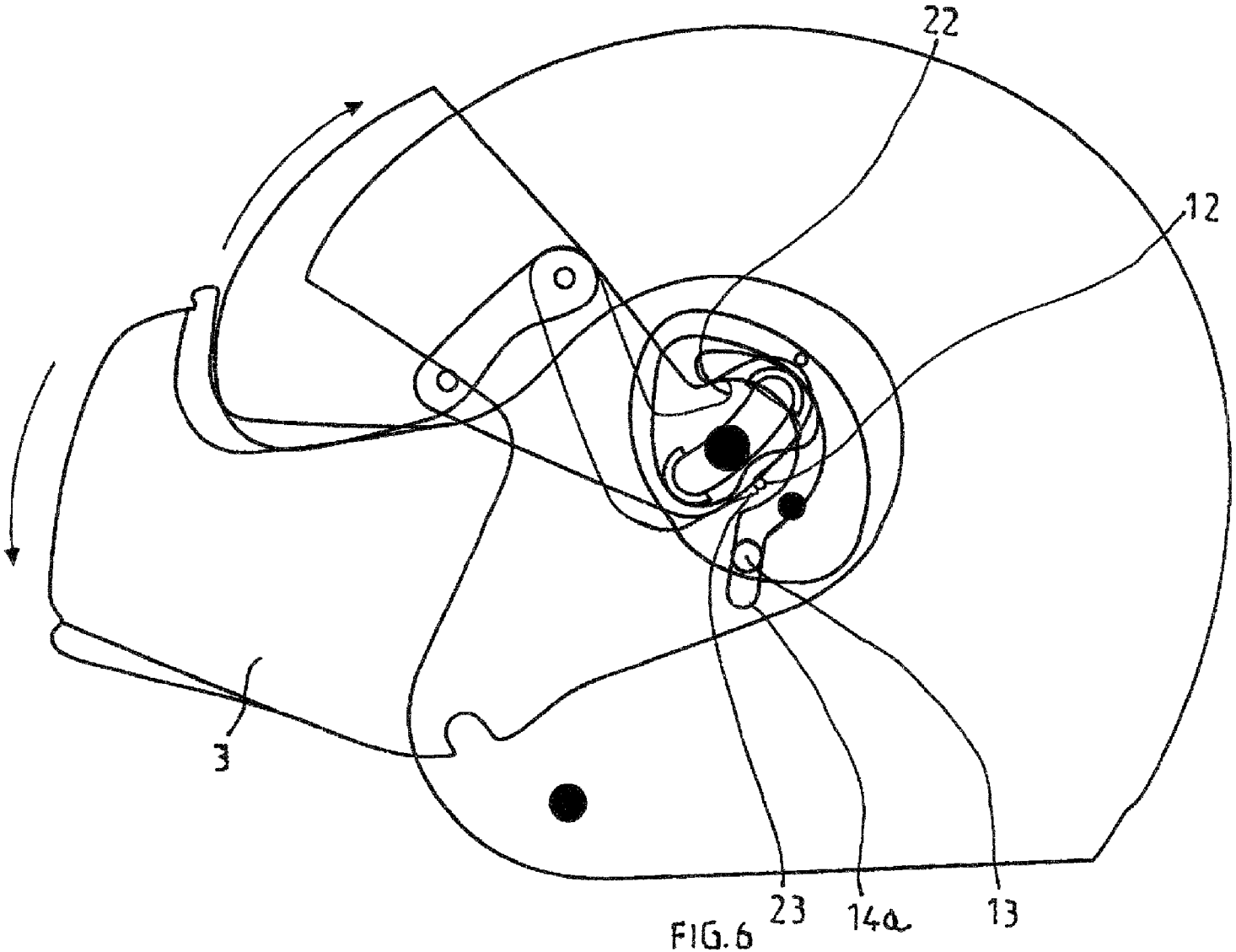
FIG. 6 shows the return of the chinstrap over the shell and FIG. 7 shows a position of the chinstrap reaching its lowered position with mobility of the visor.

In FIG. 6, following this position, the user lowers chin strap 3. On the return of chin strap 3, drive device 13 once again adopts tangential portion 14*b* of track 14 up to radial part 14*a* which is roughly perpendicular to it. This leads to the opposite action of cam 10 inclining towards the bottom quickly.

To allow a return of chin strap 3 to the lowered position when visor 2 has already been lowered, a mechanism allows prior raising of the visor as shown in FIG. 6.

More exactly, finger 12 is formed on cam 10 to coact with a surface 23 formed at the rear of rod 7 so that finger 12 pushes surface 23 when cam 10 is actuated rotatably by lowering chin strap 3.

At the end of rotation, finger 12 is released from surface 23 thereby making it possible for visor 2 to be lowered and applied on zone 4.

Figure 7:
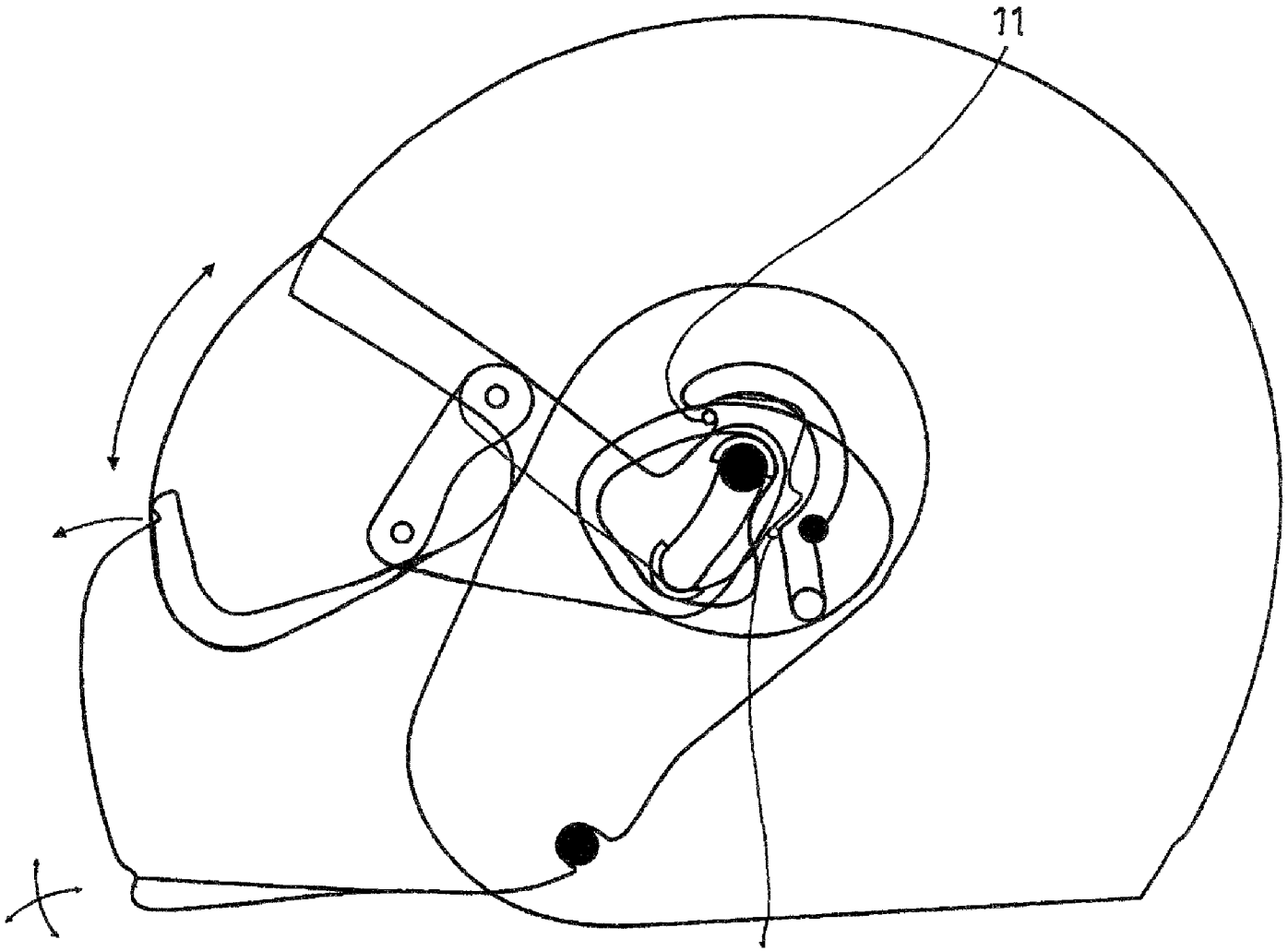

This causes a return to the initial position shown on FIG. 1 and FIG. 7.

In the low position, chin strap 3 is maintained in position by a lower stop such as lug 24. A locking system is advantageously envisaged in order to fix the chin strap in this position.

REFERENCES

1. Shell
2. Visor
3. Chin strap
4. Bearing zone
5. Rotational axis
6. Shell side
7. Rod
8. Lateral support
9. Oblong hole of lateral support
10 Cam
11 Finger
12 Finger
13 Drive device
14 Displacement track
14*a*. Radial part
14*b* Tangential part
15. Cavity
16. Cam axis of rotation
17. Upper stop
18. Lower stop
19. Drive part
21. Edge
22. Raising bearing surface
23. Lowering bearing surface
24. Lug

The invention claimed is:

1. A protective helmet comprising:

a shell (1) on which are rotatably mounted a visor (2) and a chin strap (3), with a lower portion of the visor (2) being urged to rest on a zone (4) of the chin strap (3) when the visor (2) and the chin strap (3) are lowered, with the chin strap (3) capable of being raised around the visor (2); and means providing additional mobility of the visor (2) configured to approach or move away a lower edge of the visor (2) from a raising trajectory of the zone (4) on the chin strap (3).

2. The protective helmet according to the claim 1, wherein the means for providing additional mobility are means for inclining the visor (2).

3. The protective helmet according to the claim 2, wherein the means for inclining the visor (2) comprise, on each side (6) of the shell (1), a rod (7) assembled to swivel on the visor (2) at one end, and another end on a rotational axis (5) of the visor (2) on the shell (1).

4. The protective helmet according to the claim 3, further comprises, on the each side (6) of the shell (1), a lateral support (8) joined to the visor (2), with an oblong hole (9) to guide the rotational axis (5).

5. The protective helmet according to claim 1, further comprising means for interlocking the means for providing additional mobility of the visor (2) for the raising of the chin strap (3).

6. The protective helmet according to claim 1, further comprising means for controlling rotation of the visor (2) relative to the shell (1) by the raising of the chin strap (3) manually.

7. The protective helmet according to the claim 4, further comprising interlocking means for controlling in rotation and inclination of the visor (2) with the raising of the chin strap (3) manually, said interlocking means comprising:

a cam (10) rotatably mounted on the shell (1) and drive means configured to rotatably drive the cam (10) by the rotation of the chin strap (3) during a first phase of the raising of the chin strap (3);

at least one finger (11) joined to the cam (10) which presses on a bearing surface (22) of the rod (7) so as to drive the rod (7) and the visor (2) rotatably;

a cavity (15) formed in the cam (10) that can be applied on an upper stop (17) and a lower stop (18) forming limits of an oblong hole (9) so as to drive the lateral support (8) around the axis of rotation.

8. The protective helmet according to claim 7, wherein the drive means comprise a drive body (13) joined to the cam (10) and guided in a track (14) formed in a drive part (19) joined to the chin strap (3), said track (14) comprising an appreciably radial part (14*a*) within which the drive body (13) is driven rotatably and a roughly tangential part (14*b*) within which the drive body (13) is not driven rotatably.

9. The protective helmet according to claim 7, wherein the cam (10) has another finger (12) that can exert a pressure on another bearing surface (23) of the rod (7) so as to drive the rod (7) and the visor (2) rotatably in an upward movement when the chin strap (3) moves downwards and the visor (2) is in a lowered position.

10. The protective helmet according to claim 7, wherein the interlocking means, in rotation relative to the shell (1) with the raising of the chin strap (3), are configured to generate a higher angular speed for the visor (2) than for the chin strap (3).

11. The protective helmet according to claim 2, further comprises means for interlocking the means providing additional mobility of the visor (2) to the raising of the chin strap (3).

12. The protective helmet according to claim 3, further comprising means for interlocking the means providing additional mobility of the visor (2) to the raising of the chin strap (3).

13. The protective helmet according to claim 4, further comprising means for interlocking the means providing additional mobility of the visor (2) to the raising of the chin strap (3).

14. The protective helmet according to claim 2, further comprising means for controlling the rotation of the visor (2) relative to the shell (1) by the raising of the chin strap (3).

15. The protective helmet according to claim 3, further comprising means for controlling the rotation of the visor (2) relative to the shell (1) by the raising of the chin strap (3).

16. The protective helmet according to claim 4, further comprising means for controlling the rotation of the visor (2) relative to the shell (1) by the raising of the chin strap (3).

17. The protective helmet according to claim 5, further comprising means for controlling the rotation of the visor (2) relative to the shell (1) by the raising of the chin strap (3).

18. The protective helmet according to claim 8, wherein the cam (10) has another finger (12) that can exert a pressure on another bearing surface (23) of the rod (7) so as to drive the rod (7) and the visor (2) rotatably in an upward movement when the chin strap (3) moves downwards and the visor (2) is lowered.

19. The protective helmet according to claim 7, wherein the interlocking means for interlocking the visor (2) in rotation relative to the shell (1) with the raising of the chin strap (3) are configured to generate a higher angular speed for the visor (2) than for the chin strap (3).

20. The protective helmet according to claim 8, wherein the interlocking means for interlocking the visor (2) in rotation relative to the shell (1) with the raising of the chin strap (3) are configured to generate a higher angular speed for the visor (2) than for the chin strap (3).

* * * * *